US007987634B2

(12) United States Patent
Bailey et al.

(10) Patent No.: US 7,987,634 B2
(45) Date of Patent: Aug. 2, 2011

(54) LOW-PROFILE MITER APPARATUS AND SYSTEM

(76) Inventors: Lance D. Bailey, Omaha, NE (US); Randall R. Bailey, Omaha, NE (US); Brian M. Beck, Omaha, NE (US); David R. Herdrich, Omaha, NE (US)

( * ) Notice: Subject to any disclaimer, the term of this patent is extended or adjusted under 35 U.S.C. 154(b) by 0 days.

(21) Appl. No.: 12/116,612

(22) Filed: May 7, 2008

(65) Prior Publication Data

US 2008/0276547 A1 Nov. 13, 2008

Related U.S. Application Data

(60) Provisional application No. 60/917,039, filed on May 9, 2007.

(51) Int. Cl.
*E04D 13/00* (2006.01)

(52) U.S. Cl. ..... 52/12; 52/13; 52/15; 52/24; 52/58; 52/97; 249/48.1

(58) Field of Classification Search ..... 52/12–16, 52/24–26, 58–62, 97; 249/48.1
See application file for complete search history.

(56) References Cited

U.S. PATENT DOCUMENTS

| | | | | |
|---|---|---|---|---|
| 2,120,395 | A * | 6/1938 | Dean | 210/474 |
| 2,537,243 | A * | 1/1951 | Swartz | 52/12 |
| 3,300,911 | A * | 1/1967 | Riddell | 52/16 |
| 6,009,672 | A * | 1/2000 | Kuhns | 52/13 |
| 6,256,933 | B1 * | 7/2001 | Kuhns | 52/13 |
| 6,412,229 | B2 * | 7/2002 | Kuhns | 52/13 |
| 2001/0017008 | A1 * | 8/2001 | Kuhns | 52/11 |
| 2002/0124476 | A1 * | 9/2002 | Iannelli | 52/11 |

* cited by examiner

*Primary Examiner* — Jeanette E. Chapman
(74) *Attorney, Agent, or Firm* — Dax D. Anderson; Kirton & McConkie

(57) ABSTRACT

A gutter cover inside miter to be used with both open valley and closed valley roof miters, where the gutter cover inside miter is formed by coupling two primary member having a stem, legs, a tapered trough, a diverter and a plurality of draining and guide vents oriented to accommodate a variety of water flows. The gutter cover inside miter is also used with an underlying gutter cover as a system to improve the functionality of the gutter cover.

16 Claims, 3 Drawing Sheets

LOW-PROFILE MITER APPARATUS AND SYSTEM

RELATED APPLICATIONS

This application claims priority to provisional patent application No. 60/917,039, filed May 9, 2007, entitled "Low-Profile Miter Apparatus and System."

BACKGROUND

The Field of the Invention

Inventions in the gutter cover art attempt to prevent debris such as leaves and other materials which may fall on a roof from entering, obstructing clogging or generally preventing water from flowing off the roof and into the underlying gutter system. Numerous gutter covers have been developed to cover the straight sections of a gutter, however most covers that operate via surface tension or capillary action are inadequate to properly channel water flow from an inside valley of a building's roofing structure. This is particularly problematic where a gutter cover is fixed to the building, or removal of the gutter cover might damage the building because water overflowing the gutter cover in an inside corner exposes the building foundation and walls to undesirable moisture. Alternatively, many current solutions are variations of a splash guard, which traps debris in the inside valley or corner and requires intervention to remove the debris. A properly constructed miter can be used in inside corners formed in roof lines to prevent water from passing over the gutter cover in a stream and debris from becoming trapped at the corner or in the roofing inside valley.

SUMMARY

An exemplary embodiment of the invention is a gutter cover inside miter having a plurality of drains to direct and drain water and shed debris.

DETAILED DESCRIPTION OF EXEMPLARY EMBODIMENTS

This specification describes exemplary embodiments and applications of the invention. The invention, however, is not limited to these exemplary embodiments and applications or to the manner in which the exemplary embodiments and applications operate or are described herein. Moreover, the Figures may show simplified or partial views, and the dimensions of elements in the Figures may be exaggerated or otherwise not in proportion for clarity. In addition, as the terms "on" and "attached to" are used herein, one object (e.g., a material, a layer, a substrate, etc.) can be "on" or "attached to" another object regardless of whether the one object is directly on or attached to the other object or there are one or more intervening objects between the one object and the other object. Also, directions (e.g., above, below, top, bottom, side, "x," "y," "z," etc.), if provided, are relative and provided solely by way of example and for ease of illustration and discussion and not by way of limitation.

An open valley is defined as the roof miter joint where the joint formed thereby is not shingled, but flashing may be placed.

A closed valley is defined as the roof miter joint where the joint formed thereby is shingled and no flashing shows.

Flex point is defined as a bend or slot formed to allow a gutter cover inside miter to be bent to match different roof slope angles.

Figure 1:
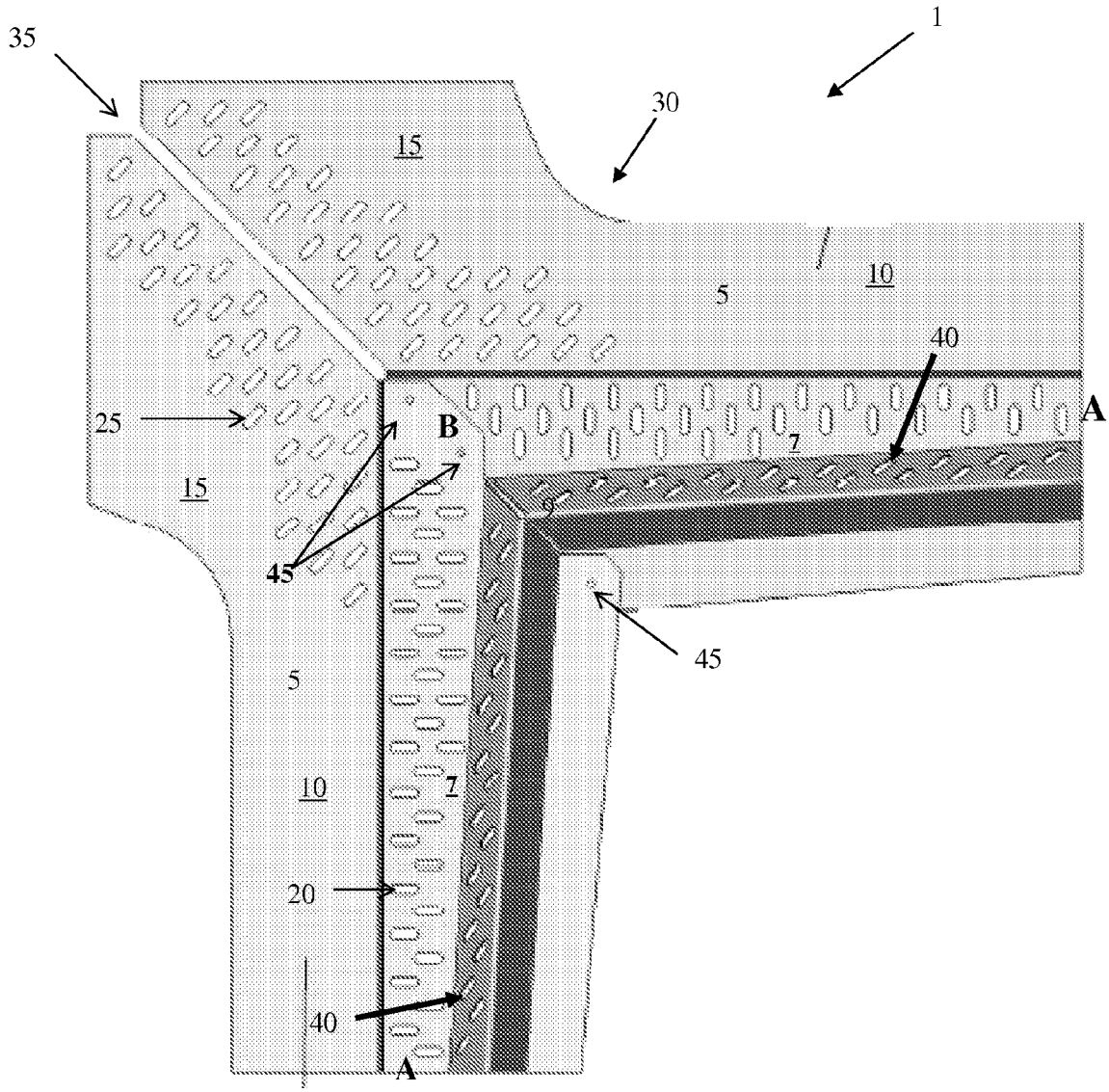
FIG. 1 is a top view of an exemplary embodiment of a gutter cover inside miter.
Figure 2:
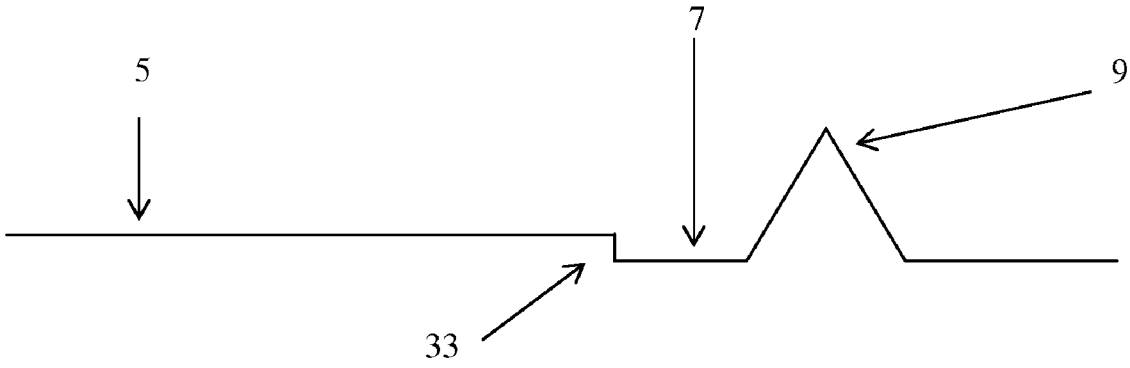
FIG. 2 is a profile view of an exemplary embodiment of a gutter cover inside miter.
Figure 3:
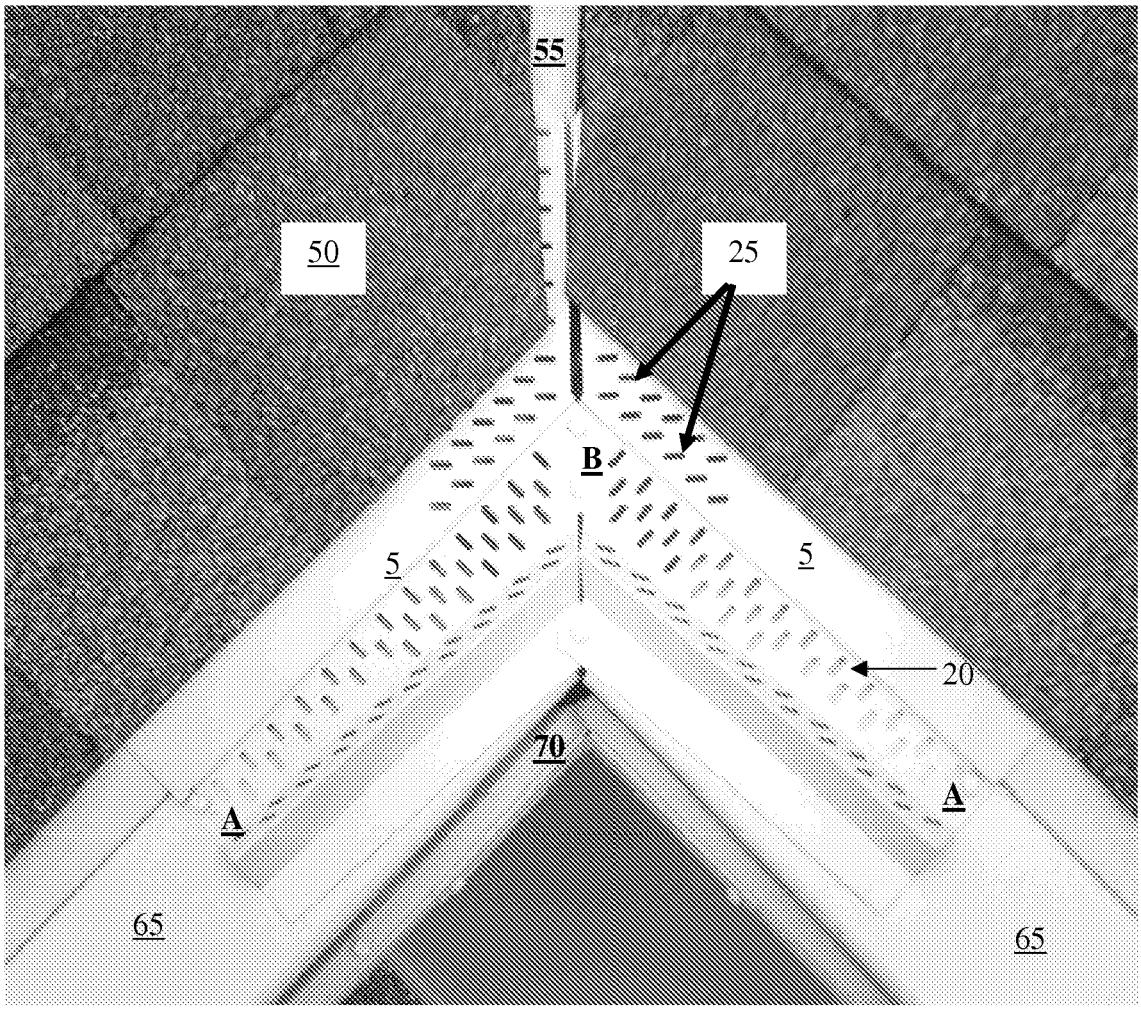
FIG. 3 illustrates an exemplary embodiment of an installed gutter cover inside miter.

An exemplary embodiment of a gutter cover inside miter 1 comprises a primary panel member 5 having a trough 7, a diverter 9, a leg 10 section and a stem 15 section. The primary panel member 5 is preferably formed of 0.024 inch aluminum with a baked enamel painted finish. An exemplary embodiment may be approximately thirteen inches long and eight inches wide, sufficient to cover a gutter miter joint. The gutter miter 1 comprises two chiral panel members 5, or may comprise one contiguous unit and may be used in a system when the two straight panel members are mounted over a gutter cover 65 known in the art to prevent debris from entering a gutter system and obstructing water flow, FIG. 3.

The trough 7 of the exemplary embodiment comprises a lower section wherein water flows and drains into an underlying gutter or onto a surface of an underlying gutter cover 65. The trough 7 is wider at the center of the primary panel than at the outer edge, thus forming a taper along the AB axis as shown. The trough's edge 33 is preformed to allow the stem 15 and leg 10 to be bent to match the pitch of an adjacent roof.

The stem 15 is an extension of the primary panel 5, with a boundary forming a cutout 30 to accommodate roofing structures commonly found below shingles 50. The stem 15 is placed into a roof valley formed where two roof angles meet. The stem 15 comprises a open slot or flex slot 35 to accommodate roofs of different pitches, open valleys and closed valleys. The slot 35 allows the gutter cover inside miter 1 to accommodate a variety of roofing configurations.

The gutter cover inside miter 1 has a plurality of drain vents which direct water flow and allow water to pass through to an underlying gutter or onto the surface of an underlying gutter cover 65. Drain vents 20 located in the trough 7, are oval-shaped to allow maximum water to pass through to the underlying gutter 70 or gutter cover 65 while preventing debris from passing through. Also, a plurality of guide vents 25 are formed in the stem 15 portion to both manipulate the flow direction and speed of the water flow.

In practice, rain water flows directly down the roof's fall line and the flow direction does not change until it is obstructed. The guide vents 25 are positioned to be orthogonal to the flow direction of water flowing down a valley and obstruct the flow to redirect the water's flow direction onto the under lying flashing 55 or gutter cover 65 and cause the water to slow as it flows over the guide vents 25. In the exemplary embodiment the drain vents 20 are off-set by forty-five degrees from the guide vents 25 to accommodate the natural flow directions from the roof. It is expected that water will flow directly down the roof or even pass through the guide vents 25 and into the trough 7 where the oval-shaped drain vents 20 will allow the water to flow into the underlying gutter 70 or onto the surface of an underlying gutter cover 65. Trough 7 directs water away from the highest water flow coming from the roof's valley.

The gutter cover inside miter 1 can accommodate large amounts of water with its diverter 9, which is preformed into the primary panel member 5. In an exemplary embodiment, the diverter 9 is a low profile dam with a plurality of diverter guide vents 40 which allow large amounts of water to pass through in large storms. The low-profile is also aesthetically pleasing and allows debris to pass over the miter and out of the roof valley without significant obstruction such as is found with taller and more perpendicular diverter solutions. The vents 40 are formed with a slant to manipulate and guide water flowing there through.

In addition, the diverter 9 is angled to direct water flowing into the diverter at a slight backward angle towards the roofline. This redirection again slows the water flow and causes it to sheet onto the surface of an underlying gutter cover 65. Diverter 9 prevents high water flow conditions from overflowing the system and flowing over the nose of a gutter cover 65 and beyond the gutter all together. The backside of the diverter 9 is solid with no vents formed therein to prevent water from flowing past the diverter and to allow for an additional diverter system to be placed thereon if water flow conditions warrant.

Pilot holes 45 are formed in the primary member 15 along the interior edge where the panels are selectively coupled. In addition the pilot holes aid attaching the devices together in a consistent manner for all applications. The pilot holes are not present in a version that is manufactured as one contiguous unit.

Although specific embodiments and applications of the invention have been described in this specification, there is no intention that the invention be limited to these exemplary embodiments and applications or to the manner in which the exemplary embodiments and applications operate or are described herein.

We claim:

1. A gutter cover inside miter comprising:

a stem comprising a plurality of vents formed therein, a leg extending from the stem at an acute angle;

a trough formed in the leg wherein the trough is wider at the center of the miter than at the outer edge; and a raised diverter formed on the leg and adjacent the trough and forming an angled junction with the trough, the diverter comprising drains.

2. The gutter cover inside miter of claim 1, wherein the acute angle is approximately forty-five degree angle with the stem.

3. The gutter cover inside miter of claim 1 further comprising a plurality of water flow slowing vents formed in the stem formed orthogonal to an edge of the primary panel member.

4. The gutter cover inside miter of claim 1 further comprising a plurality of vents formed in the trough.

5. The gutter cover inside miter of claim 1 further comprising a plurality of vents formed in the diverter positioned to direct the flow of water and allow water to pass therethough.

6. The gutter cover inside miter system of claim 1 further comprising a diverter forming a boundary of the trough.

7. The gutter cover inside miter system of claim 1 further comprising a cut out.

8. The gutter cover inside miter system of claim 1 further comprising a flex slot.

9. The gutter cover inside miter system of claim 1 further comprising oval shaped drain vents positioned so that the long axis of the oval is orthogonal to the direction of flowing rain water.

10. A gutter cover inside miter system comprising:

a Y-shaped miter;

a water gutter coupled to the edge of a roof;

a low-profile gutter cover inside miter comprising a stem portion and a leg portion, the leg portion extending outward from the stem;

wherein the gutter cover inside miter has a profile that includes a trough separating a panel portion from a raised diverter; and wherein the panel portion of the gutter cover profile is disposed substantially over the roof and the trough and raised diverter of the gutter cover profile are disposed substantially over the water gutter.

11. The gutter cover system of claim 9, wherein the stem portion includes a plurality of vents.

12. The gutter cover system of claim 10, wherein the plurality of elongated vents and oriented such that the widest portion of the elongated vent is perpendicular to flow of water over the inside miter.

13. The gutter cover system of claim 9, wherein the trough of the gutter cover profile includes a plurality of vents.

14. The gutter cover system of claim 9, wherein the raised diverter of the gutter cover profile includes a plurality of vents.

15. The gutter cover system of claim 9, wherein the raised diverter of the gutter cover profile is substantially triangular in shape.

16. The gutter cover system of claim 9, wherein the trough and raise diverter of the gutter cover profile is disposed on the leg portion.

* * * * *